US009763491B2

(12) United States Patent
Bryne

(10) Patent No.: US 9,763,491 B2
(45) **Date of Patent: *Sep. 19, 2017**

(54) SHOE SOLE MOUNTING STANDARD FOR BICYCLE CLEAT

(71) Applicant: Speedplay, Inc., San Diego, CA (US)

(72) Inventor: Richard M. Bryne, San Diego, CA (US)

(73) Assignee: Speedplay, Inc., San Diego, CA (US)

( * ) Notice: Subject to any disclaimer, the term of this patent is extended or adjusted under 35 U.S.C. 154(b) by 319 days.

This patent is subject to a terminal disclaimer.

(21) Appl. No.: 13/622,893

(22) Filed: Sep. 19, 2012

(65) Prior Publication Data

US 2014/0075786 A1 Mar. 20, 2014

Related U.S. Application Data

(63) Continuation of application No. 12/334,402, filed on Dec. 12, 2008, now Pat. No. 8,272,150.

(51) Int. Cl.
*A43B 5/14* (2006.01)
*A43C 15/16* (2006.01)

(52) U.S. Cl.
CPC ..... *A43B 5/14* (2013.01); *A43C 15/161* (2013.01)

(58) Field of Classification Search
CPC ..... A43B 5/14; A43C 15/00; A43C 15/161
USPC ..... 36/131, 134, 124, 67 A, 25 R; 74/594, 74/594.6
See application file for complete search history.

(56) References Cited

U.S. PATENT DOCUMENTS

| | | | | |
|---|---|---|---|---|
| 1,370,730 | A | | 3/1921 | Carver |
| 3,808,910 | A | | 5/1974 | Desbois |
| 3,859,867 | A | | 1/1975 | Haines et al. |
| 4,055,005 | A | | 10/1977 | Meinhart |
| 4,298,210 | A | | 11/1981 | Lotteau |
| 4,488,453 | A | | 12/1984 | Drugeon et al. |
| 4,506,463 | A | * | 3/1985 | Chassaing ..... 36/131 |
| 4,599,914 | A | | 7/1986 | Dunn et al. |
| 4,599,915 | A | | 7/1986 | Hlavac et al. |

(Continued)

FOREIGN PATENT DOCUMENTS

| | | |
|---|---|---|
| DE | 2816189 A1 | 8/1979 |
| DE | 3315282 A1 | 10/1984 |

(Continued)

OTHER PUBLICATIONS bont.com, Bont Crono, www.bont.com/cycling/pages/bontcrono.html.

(Continued)

*Primary Examiner* — Sally Haden
*Assistant Examiner* — Jillian K Pierorazio
(74) *Attorney, Agent, or Firm* — Sheppard, Mullin, Richter & Hampton LLP

(57) ABSTRACT

The present invention is embodied in a mounting standard for mounting a cleat assembly to a shoe sole having a curved underside portion and a plurality of mounting holes. The mounting standard is configured so that the cleat assembly can be moved forward or rearward with respect to the curved underside portion of the shoe sole without significantly affecting the distance between the cleat assembly and a user's foot. The present invention is also embodied in a shoe configured to receive a user's foot, the shoe comprising a shoe sole and a mounting standard.

17 Claims, 6 Drawing Sheets

(56) References Cited

U.S. PATENT DOCUMENTS 4,686,867 A * 8/1987 Bernard ..... B62M 3/086 36/131
4,735,107 A 4/1988 Winkie
4,739,564 A 4/1988 Eser
4,803,894 A 2/1989 Howell
4,815,333 A 3/1989 Sampson
4,819,504 A 4/1989 Sampson
4,827,633 A 5/1989 Feldstein
4,827,797 A 5/1989 Le Faou et al.
4,840,086 A 6/1989 Bidal
4,893,420 A * 1/1990 Bezin et al. ..... 36/131
4,898,063 A 2/1990 Sampson
4,899,618 A 2/1990 Christol
4,936,164 A 6/1990 Forke
4,942,778 A 7/1990 Bryne
5,007,185 A 4/1991 Lazarski
5,014,571 A * 5/1991 Dapezi ..... 74/594.6
5,031,342 A 7/1991 Crook
5,079,968 A 1/1992 Starner
5,081,883 A * 1/1992 Romano ..... B62M 3/086 36/131
5,199,324 A 4/1993 Sain
5,205,056 A * 4/1993 Okajima ..... A43B 5/14 36/131
5,213,009 A * 5/1993 Bryne ..... 74/594.6
5,284,066 A 2/1994 Weiss
5,321,995 A 6/1994 Zedan
5,325,738 A 7/1994 Bryne
5,363,573 A * 11/1994 Kilgore et al. ..... 36/131
5,371,903 A 12/1994 Lew
5,406,647 A 4/1995 Lew
5,505,111 A * 4/1996 Nagano ..... B62M 3/086 36/131
5,546,829 A 8/1996 Bryne
5,553,516 A 9/1996 Weiss
5,557,985 A 9/1996 Nagano
5,570,894 A * 11/1996 Brandner ..... 280/11.221
5,575,184 A 11/1996 De Schrijver
5,606,894 A 3/1997 Bryne
5,657,558 A 8/1997 Pohu
5,685,093 A * 11/1997 Lin ..... A43B 1/0054 36/131
5,687,619 A 11/1997 Bryne
5,697,262 A 12/1997 Chen
5,713,587 A * 2/1998 Morrow et al. ..... 280/14.21
5,727,429 A 3/1998 Ueda
5,765,450 A 6/1998 Kruger et al.
5,778,739 A 7/1998 Takahama
5,784,931 A 7/1998 Ueda
5,806,379 A 9/1998 Nagano
5,852,955 A 12/1998 Crisick et al.
5,860,330 A * 1/1999 Code ..... B62M 3/086 36/131
5,862,716 A 1/1999 Bryne
5,878,514 A * 3/1999 Ueda et al. ..... 36/131
5,916,332 A 6/1999 Chen
D413,711 S 9/1999 Hicks, Jr.
6,003,408 A 12/1999 Hervig
6,014,914 A 1/2000 Ueda
6,053,522 A * 4/2000 Fogarty ..... B63B 35/812 280/607
6,070,493 A 6/2000 Chen
6,128,973 A 10/2000 Nagano
6,151,989 A 11/2000 Ueda
6,189,242 B1 * 2/2001 Lin ..... A43B 5/14 36/117.1
6,205,885 B1 3/2001 Hermansen et al.
6,244,136 B1 6/2001 Chen
6,309,010 B1 10/2001 Whitten
6,425,304 B1 7/2002 Bryne
6,446,529 B1 9/2002 Tanaka
6,453,771 B1 9/2002 Takahama et al.
6,490,948 B2 12/2002 Tanaka
6,494,117 B1 12/2002 Bryne
6,581,493 B1 6/2003 Gillane
D481,974 S 11/2003 Evans
7,013,754 B2 3/2006 Milanowski
7,017,445 B2 * 3/2006 Bryne ..... B62M 3/086 74/560
7,174,807 B2 2/2007 Bryne
7,228,760 B2 * 6/2007 Reboullet ..... 74/594.6
7,322,259 B2 1/2008 De Bast et al.
7,383,646 B2 6/2008 Hall
7,472,498 B2 1/2009 Bryne
D595,620 S 7/2009 Kingsbury
7,779,560 B2 8/2010 Kay
7,856,905 B2 12/2010 Hsieh
7,877,904 B2 2/2011 Bryne
8,272,150 B2 * 9/2012 Bryne ..... A43B 5/14 36/131
8,387,287 B2 3/2013 Kay et al.
D683,665 S 6/2013 Smith
2001/0008093 A1 7/2001 Heim
2002/0144569 A1 10/2002 Tanaka
2003/0051576 A1 3/2003 Muraoka
2004/0187635 A1 9/2004 Bryne
2004/0237705 A1 12/2004 Conarro et al.
2005/0022432 A1 * 2/2005 Chretien ..... A43B 5/14 36/131
2005/0155452 A1 7/2005 Frey
2005/0210712 A1 * 9/2005 Jau, Jr. ..... A43B 5/14 36/131
2005/0252337 A1 11/2005 Chen
2005/0284253 A1 12/2005 Hervig
2006/0070489 A1 4/2006 Chen
2006/0080865 A1 * 4/2006 Chao ..... A43B 5/14 36/131
2006/0236809 A1 10/2006 Bryne
2007/0084086 A1 * 4/2007 Bryne ..... A43B 5/14 36/131
2007/0193402 A1 8/2007 Hsieh
2008/0110294 A1 * 5/2008 Bryne ..... A43B 5/14 74/594.6
2009/0085313 A1 * 4/2009 Landry ..... 280/11.18
2010/0107451 A1 5/2010 Kay et al.
2010/0301632 A1 12/2010 Bryne
2011/0283568 A1 11/2011 Woodford
2012/0047772 A1 * 3/2012 Lin ..... A43B 5/14 36/134
2012/0103131 A1 5/2012 Bryne
2012/0233891 A1 9/2012 Woodford

FOREIGN PATENT DOCUMENTS

DE 3426103 A1 1/1986
DE 3149345 C2 1/1989
DE 202005019542 U1 2/2006
EP 0012097 A2 6/1980
EP 0015803 A2 9/1980
EP 0106162 A1 4/1984
EP 0153210 A1 8/1985
EP 0155114 A2 9/1985
EP 0293340 A2 11/1988
EP 0359134 A2 3/1990
EP 0485956 A1 5/1992
EP 0516013 A2 12/1992
EP 0619219 A1 10/1994
EP 0826587 A1 3/1998
EP 0894446 A1 2/1999
FR 2279607 A1 2/1976
FR 2518041 A1 6/1983
FR 2609270 A1 7/1988
FR 2711963 A1 5/1995
FR 2775424 A1 9/1999
FR 2932450 A1 12/2009
JP 64-23202 7/1989
JP 05111402 5/1993
JP H11-103902 4/1999
JP 2005-46629 2/2005
TW 368973 9/1999
TW 392662 6/2000
TW 200303278 9/2003

(56) References Cited

FOREIGN PATENT DOCUMENTS

| | | |
|---|---|---|
| TW | M293881 | 7/2006 |
| TW | I308543 | 4/2009 |
| WO | WO2004089741 | 10/2004 |

OTHER PUBLICATIONS pearlizumi.com, PI Aero Lycra Shoe Cover, www.pearlizumi.com/product.pjp?mode=view&pc_id=50&product_id=193110.
Frog Pedal Specifications, www.speedplay.com.
Speedplay brochure.
International Search Report for International Application No. PCT/US2010/056057, Oct. 13, 2011.
International Preliminary Report on Patentability for International Application No. PCT/US2010/056057, May 7, 2013.
European Search Report for Application No. 13190753.7-1753, Dec. 18, 2013.
Office Action for Japanese Patent Application No. 2011-540875, Dec. 12, 2013.

* cited by examiner

SHOE SOLE MOUNTING STANDARD FOR BICYCLE CLEAT

CROSS-REFERENCE TO RELATED APPLICATION

This is a continuation of application Ser. No. 12/334,402, filed on Dec. 12, 2008.

BACKGROUND OF THE INVENTION

This invention relates generally to cleat assemblies configured for releasable securement to pedals for bicycles and the like, and, more particularly, to a shoe sole mounting standard for use with such cleat assemblies.

Cleat assemblies of this particular kind typically include a spring housing and an overlaying bottom plate configured to be attached to the sole of a user's shoe. The spring housing and bottom plate, together, define a central opening sized and configured to conformably receive a pedal. The spring housing supports one or more spring clips adjacent to the central opening, for engaging and releasably retaining the pedal.

In the past, shoe soles for use with cleat assemblies of this particular kind typically included either a three-hole or four-hole mounting standard for mounting the cleat assembly onto the shoe sole. The three-hole mounting standard was curved from front to back, following the typical curvature of a shoe sole. One of the mounting holes was positioned at a forward end of the mounting standard. The other two mounting holes were positioned at a rearward end of the mounting standard.

A problem with the curved, three-hole mounting standard was that the three cleat mounting holes were poorly placed relative to the axis of the pedal. The poor placement of the mounting holes and the curvature of the mounting standard required the use of a thick adapter plate to accommodate certain cleat assemblies, such as the cleat assemblies disclosed in U.S. Patent Application Publication No. 2008/0110294. The thick adapter plate, positioned between the mounting standard and the cleat assembly, added weight to the user's shoe and prevented the pedal from being positioned as close as possible to the shoe sole. As a result, the three-hole mounting standard was not an optimal design for power transfer from the user's foot to the pedal.

The four-hole mounting standard had a planar cleat contact area and an internal four-hole fastening plate for fastening the cleat assembly onto the shoe sole. The mounting holes in the shoe sole were configured as elongated slots extending lengthwise on a portion of the sole. The internal four-hole fastening plate was a one-piece steel backing plate inside the shoe having four threaded holes to receive the four screws that attached the cleat assembly to the shoe sole. The elongated mounting holes in the shoe sole allowed the user to adjust the internal four-hole fastening plate (and thus the cleat assembly itself) forward and rearward with respect to the shoe sole.

The pedal thus contacted an area centered or "nesting" within the four-hole pattern. Hence, the mounting hardware of the four-hole design was more optimally positioned "out of the way," in front of and behind the pedal, rather than above it. The four-hole design allowed the cleat to be positioned closer to the foot, because the mounting hardware was not in the way.

A problem with the four-hole mounting standard was that, because the support surface on the shoe sole for the cleat assembly was planar, the distance between the cleat assembly and the user's foot increased as the cleat assembly was moved forward or rearward with respect to the center of the mounting standard. This increased the distance between the pedal and the user's foot. As the distance between the foot and the pedal increased, power transmission from the foot to the pedal suffered. The increased distance also made the cleat "taller" and harder to walk on. Additionally, because the internal four-hole fastening plate was a single piece of metal and was limited in movement to the forward and rearward directions, the cleat assembly could not be pivoted with respect to the shoe sole for rotational adjustment.

It should be appreciated from the foregoing description that there is a need for an improved mounting standard that overcomes the drawbacks discussed above. Specifically, there is a need for a mounting standard that avoids the need to use a thick adapter plate that increases the distance between the user's foot and the pedal. Further, there is a need for a mounting standard that avoids the problem whereby the distance between the cleat assembly and the user's foot is increased as the cleat assembly is moved forward or rearward with respect to the center of the mounting standard. Further, there is a need for a mounting standard that allows the cleat assembly to be pivoted with respect to the shoe sole. The present invention satisfies these needs and provides further related advantages.

SUMMARY OF THE INVENTION

The present invention is embodied in a mounting standard for mounting a cleat assembly to a shoe sole having a curved underside portion and a plurality of mounting holes. The mounting standard is configured so that the cleat assembly can be moved forward or rearward with respect to the curved underside portion of the shoe sole without significantly affecting the distance between the cleat assembly and a user's foot.

In one embodiment, the mounting standard comprises a contoured shim and a plurality of internal nut assemblies. The contoured shim has a curved top surface shaped generally to follow the curved underside portion of the shoe sole, a substantially flat bottom surface, and a plurality of shim holes configured for alignment with the plurality of mounting holes. Each of the plurality of internal nut assemblies has a nut protruding therefrom for receiving a threaded fastener. The mounting standard is configured so that the cleat assembly and contoured shim can be secured to the curved underside portion of the shoe sole using a single set of threaded fasteners, each threaded fastener mating with a nut protruding from one of the plurality of internal nut assemblies, through one of the plurality of mounting holes, and into one of the plurality of shim holes.

In one embodiment, the plurality of shim holes includes four shim holes. Two of the shim holes are positioned in proximity to a forward end of the contoured shim. Two of the shim holes are positioned in proximity to a rearward end of the contoured shim. Each of the plurality of shim holes is configured as an elongated slot extending widthwise on a portion of the contoured shim.

In one embodiment, each of the plurality of internal nut assemblies has two nuts protruding therefrom and a substantially flat bar connecting the two nuts. Because there are a plurality of internal nut assemblies, the mounting standard is configured to accommodate at least a slight amount of rotational adjustment of the cleat assembly with respect to the shoe sole.

The present invention is also embodied in a shoe configured to receive a user's foot, the shoe comprising a shoe sole and a mounting standard. The shoe sole has a curved underside portion and a plurality of mounting holes. The mounting standard is secured to the curved underside portion of the shoe sole for mounting a cleat assembly to the shoe sole. The mounting standard comprises a contoured shim and a plurality of internal nut assemblies. The contoured shim has a curved top surface shaped generally to follow the curved underside portion of the shoe sole, a substantially flat bottom surface, and a plurality of shim holes configured for alignment with the plurality of mounting holes. Each of the plurality of internal nut assemblies has a nut protruding therefrom for receiving a threaded fastener. The mounting standard is configured so that the contoured shim can be moved forward or rearward with respect to the curved underside portion of the shoe sole without significantly affecting the distance between the contoured shim and the user's foot.

In one embodiment, the plurality of mounting holes includes four mounting holes. Each of the plurality of mounting holes is configured as an elongated slot extending lengthwise on the curved underside portion of the shoe sole.

In one embodiment, the shoe sole further has a plurality of channels fowled in a top portion of the shoe sole and extending lengthwise on the top portion of the shoe sole. Each of the plurality of channels is configured to receive one of the plurality of internal nut assemblies.

Other features and advantages of the present invention should become apparent from the following description of the preferred embodiments, taken in conjunction with the accompanying drawings, which illustrate, by way of example, the principles of the invention.

DETAILED DESCRIPTION OF THE PREFERRED EMBODIMENTS

Figure 1:
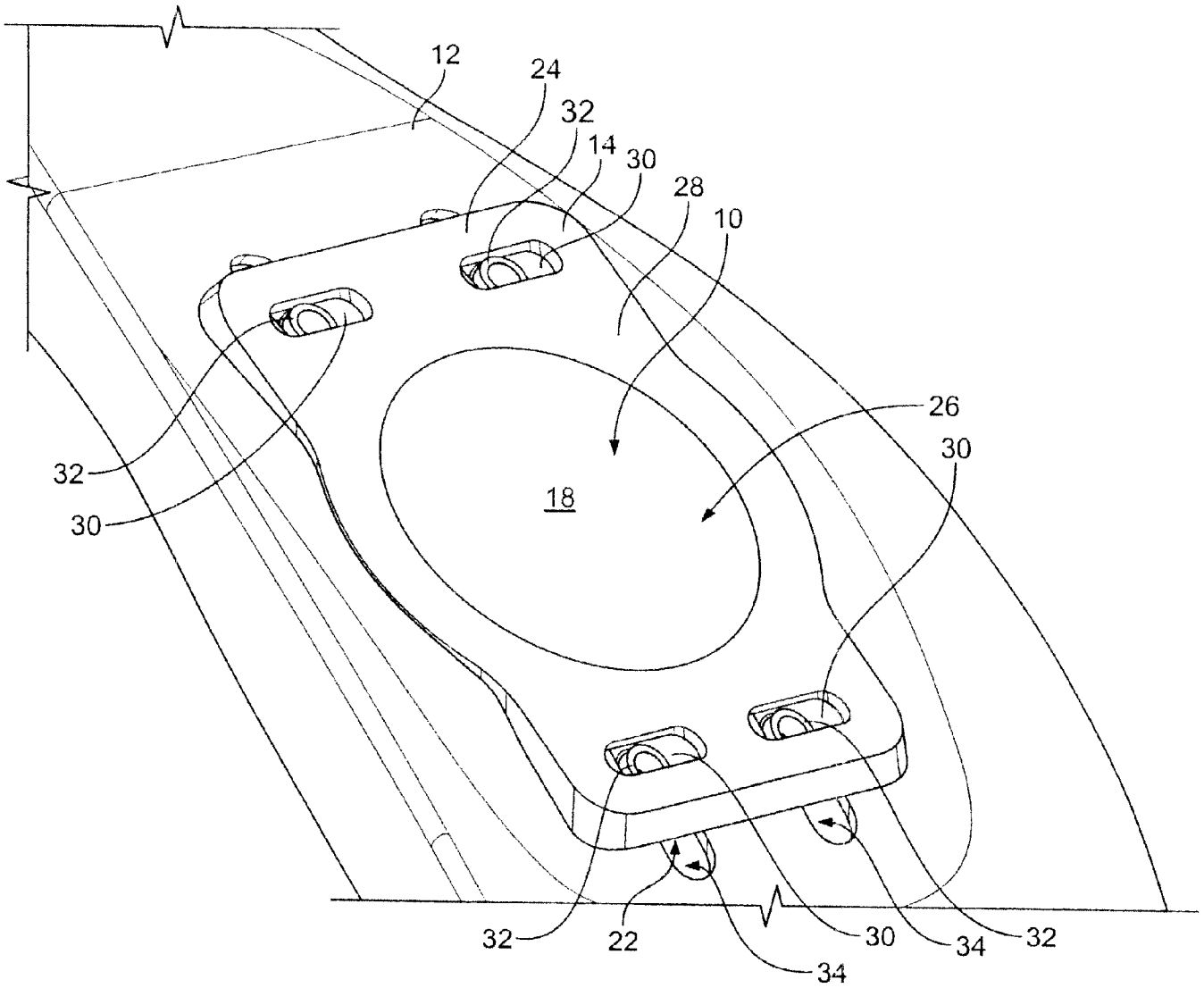
FIG. 1 is a perspective view of a mounting standard in accordance with an embodiment of the present invention, the mounting standard positioned on the underside of a curved shoe sole.

With reference to FIG. 1, there is shown a perspective view of a mounting standard 10 in accordance with an embodiment of the present invention, the mounting standard positioned on the underside of a curved shoe sole 12. The particular mounting standard and shoe sole depicted are configured for a user's right shoe, but it will be appreciated that a similar mounting standard and shoe sole could be oppositely configured for the user's left shoe. The mounting standard comprises a contoured shim 14 positioned on the underside of the shoe sole and a pair of internal nut assemblies 16 positioned within or atop the shoe sole.

The contoured shim 14 has a flat bottom surface 18 for mounting a cleat assembly and a curved top surface 20 shaped to follow the curvature of the underside of the shoe sole 12. Because the contoured shim has a flat bottom surface and a curved top surface, the contoured shim allows a flat cleat assembly to fit a curved shoe sole and to be moved forward or rearward with respect to the shoe sole without significantly affecting the distance between the cleat assembly and a user's foot.

The contoured shim 14 is thickest at its forward end 22 and rearward end 24. Moving away from the forward end or rearward end, the contoured shim gets progressively thinner. At the midpoint between the forward end and the rearward end, the contoured shim is as thin as the material or materials comprising the contoured shim will allow, while still withstanding the stresses imposed upon the contoured shim during installation and use. In one embodiment, the contoured shim is approximately 0.02 inches thick at the midpoint between the forward end and the rearward end.

In one embodiment, the contoured shim 14 comprises a thin metal center plate 26 surrounded at its edges by a plastic structure 28 having a flat bottom surface for mounting a cleat assembly and a curved top surface shaped to follow the curvature of the underside of the shoe sole 12. The center plate may be positioned within a circular hole formed in the center of the plastic structure. Stainless steel shim stock is preferably used for the center plate, as stainless steel generally offers better wear resistance than plastic for the contoured shim's main contact area with the pedal.

Positioned in the plastic structure in proximity to the forward end 22 of the contoured shim 14 are two shim holes 30 configured as elongated slots extending widthwise on a portion of the contoured shim. Positioned in proximity to the rearward end 24 of the contoured shim are two more shim holes 30 also configured as elongated slots extending widthwise on a portion of the contoured shim. Each shim hole 30 is configured to receive a nut 32 protruding from one of the pair of internal nut assemblies 16. Each nut extends through a mounting hole 34 in the shoe sole 12. Because the shim holes 30 are elongated, the contoured shim may be adjusted sideways with respect to the shoe sole, thus allowing a cleat assembly to be adjusted sideways with respect to the shoe sole.

Figure 2:
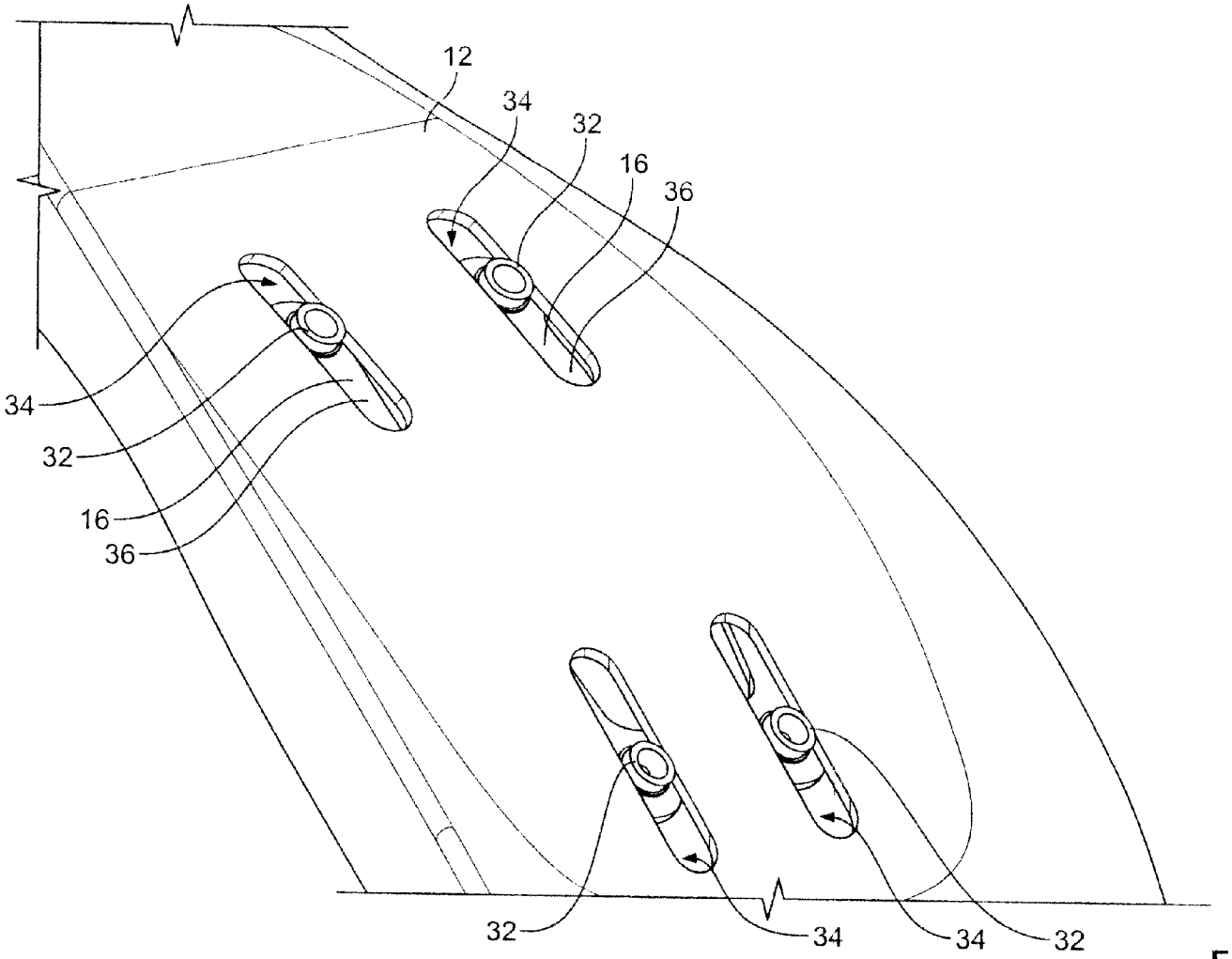
FIG. 2 is a perspective view of the shoe sole and a pair of internal nut assemblies in accordance with an embodiment of the present invention.

With reference to FIG. 2, there is shown a perspective view of the curved shoe sole 12 and pair of internal nut assemblies 16 without the contoured shim 14, the nuts 32 of the internal nut assemblies extending through the mounting holes 34 in the shoe sole. As shown in FIG. 2, the shoe sole has four mounting holes 34, each of which is configured as an elongated slot extending lengthwise on a portion of the shoe sole. Because the mounting holes 34 are elongated, the internal nut assemblies may be moved forward or rearward with respect to the shoe sole, thus allowing a cleat assembly to be moved forward or rearward with respect to the shoe sole. The fore-aft adjustment is independent from the side-to-side adjustment described above, making adjustment of the cleat assembly relatively easy. Because the shoe sole is curved, the mounting holes 34 can be made longer than mounting holes in prior art four-hole mounting standards, without increasing the thickness of the shoe sole.

Figure 3:
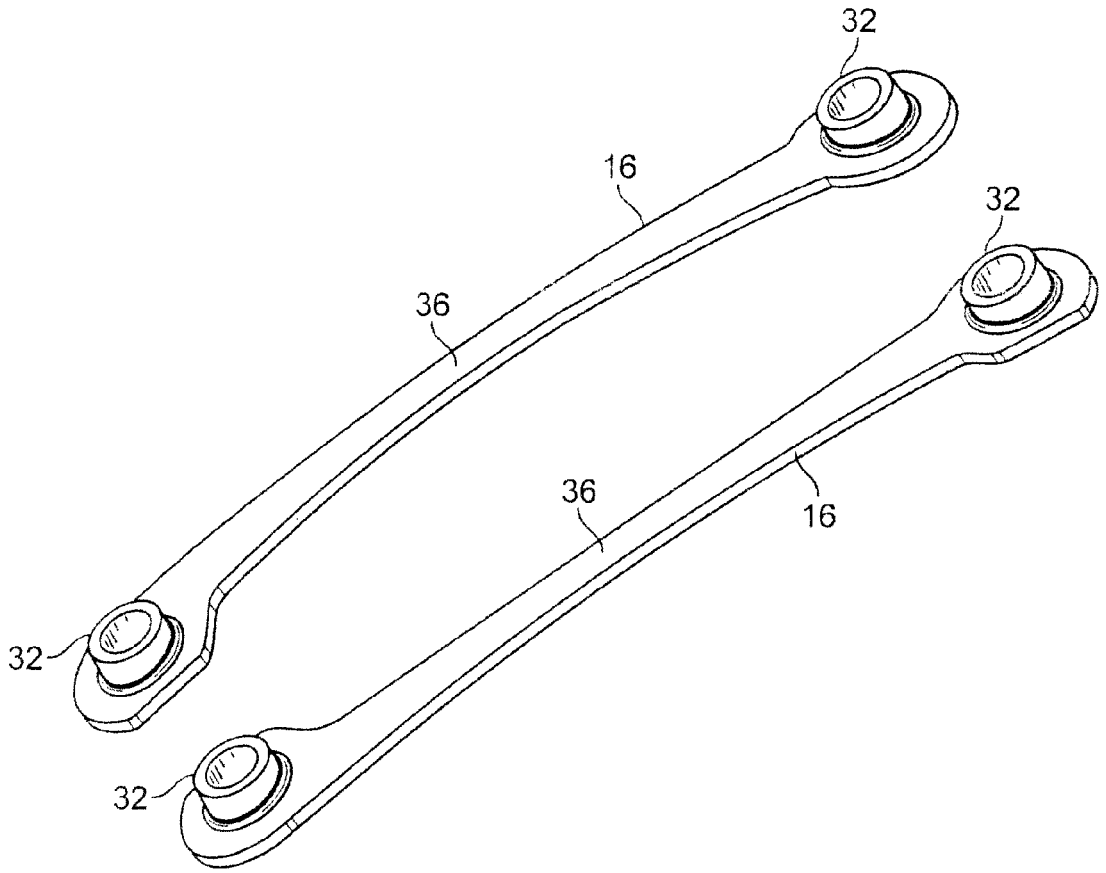
FIG. 3 is a perspective view of the pair of internal nut assemblies, in accordance with an embodiment of the present invention.

With reference to FIG. 3, there is shown a perspective view of the pair of internal nut assemblies 16, in accordance with an embodiment of the present invention. Each internal nut assembly comprises two nuts 32 connected by a flat bar 36. Each nut 32 is threaded and configured to receive a screw used to mount a cleat assembly onto the shoe sole 12. Once a screw has been received within one of the nuts, the nut at the other end of the flat bar is automatically aligned for easier installation than if four individual fasteners were used. Because the internal nut assemblies are two independent pieces rather than one piece, the internal nut assemblies accommodate a slight amount of rotational adjustment in either direction of a cleat assembly with respect to the shoe sole 12. Configuring the internal nut assemblies as two independent pieces rather than as a one-piece backing plate also requires less material, saving on weight.

Figure 4:
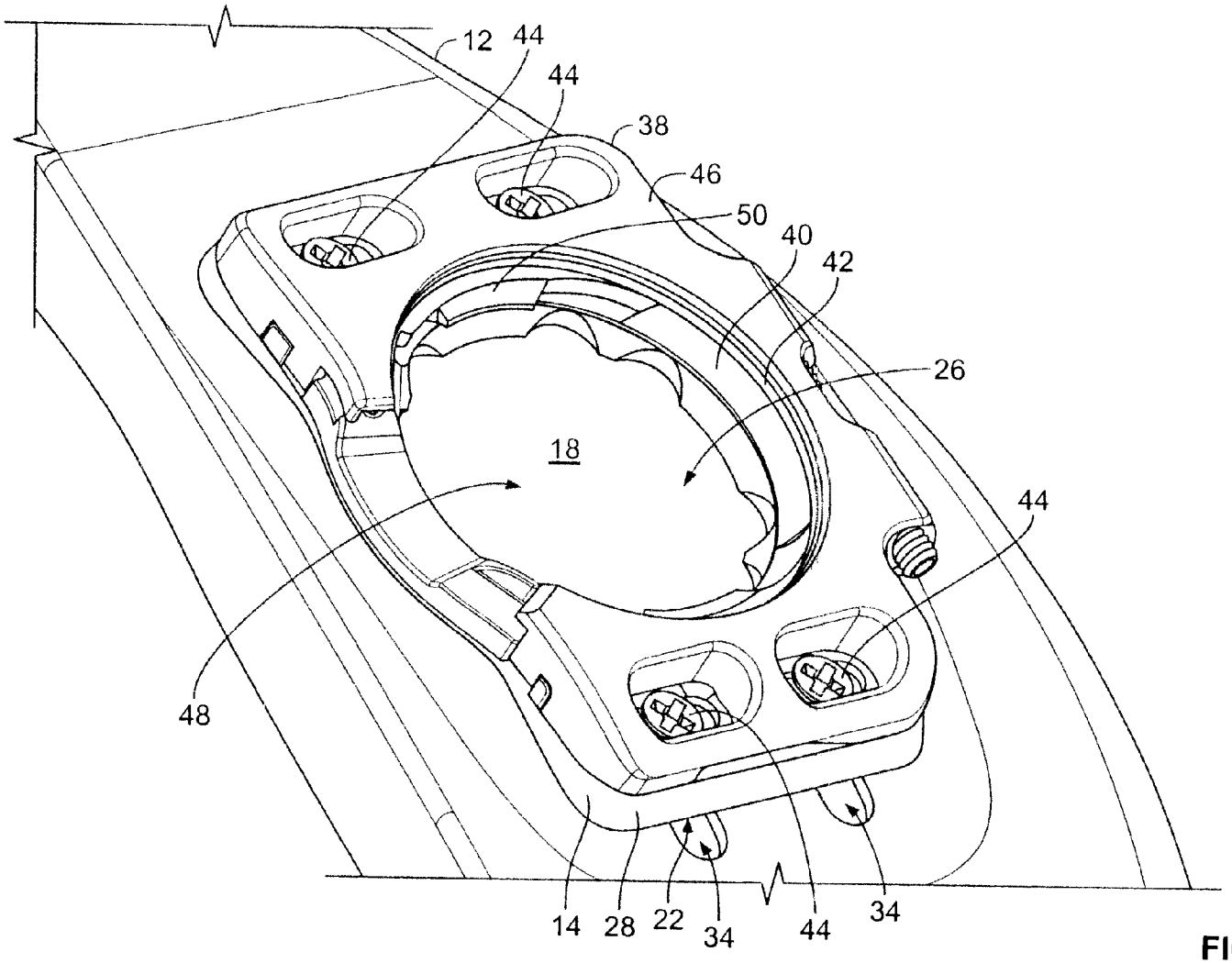
FIG. 4 is a perspective view of the mounting standard and cleat assembly, in accordance with an embodiment of the present invention, the mounting standard positioned on the underside of the curved shoe sole and the cleat assembly mounted thereon.

With reference to FIG. 4 there is shown a perspective view of the mounting standard 10 and a cleat assembly 38, in accordance with an embodiment of the present invention, the mounting standard positioned on the underside of the curved shoe sole 12 and the cleat assembly mounted thereon. The particular cleat assembly depicted is configured for attachment to the user's right shoe, but it will be appreciated that a similar cleat assembly could be oppositely configured for attachment to the user's left shoe. The cleat assembly includes a plastic spring housing 40 and a steel bottom plate 42 configured to be secured, together, by four screws 44 to the mounting standard. An elastomeric cap 46 overlays the bottom plate. The spring housing and bottom plate, together, define a circular central opening 48 sized and shaped to conformably receive a pedal (not shown). A spring clip 50 is mounted between the spring housing and the bottom plate for releasably engaging the pedal when the cleat assembly is positioned over the pedal.

Figure 5:
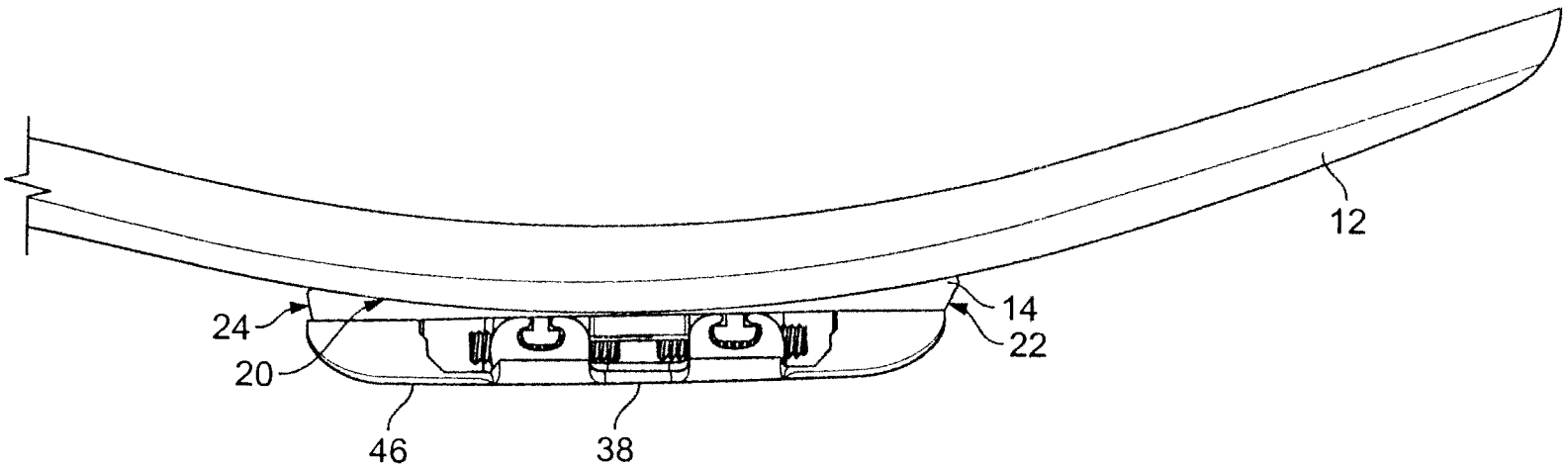
FIG. 5 is a right elevational view of the mounting standard and cleat assembly, in accordance with an embodiment of the present invention, the mounting standard positioned on the underside of the curved shoe sole and the cleat assembly mounted thereon.

With reference to FIG. 5, there is shown a right elevational view of the mounting standard 10 and cleat assembly 38, in accordance with an embodiment of the present invention, the mounting standard positioned on the underside of the curved shoe sole 12 and the cleat assembly mounted thereon. As shown in FIG. 5, the contoured shim 14 is thickest at the forward end 22 and rearward end 24, and thinnest at the midpoint between the forward end and the rearward end. Because the contoured shim does not require its own set of screws or other fasteners separate from the screws 44 that secure the cleat assembly to the pair of internal nut assemblies 16, the contoured shim can be made significantly thinner and lighter than the thick adapter plates used with prior art three-hole mounting standards. Also, because the underside of the shoe sole is curved and not planar, the distance between the cleat assembly and the user's foot is not significantly affected as the cleat assembly is moved forward or rearward with respect to the shoe sole, unlike the situation with prior art four-hole mounting standards.

Using the present invention, the user's foot is positioned significantly closer to the cleat assembly 38 than was the case using the prior art three-hole and four-hole mounting standards. This close positioning improves pedaling feel and power transfer, and makes the combination of the pedal and user's shoe more aerodynamic. Also, by positioning the user's foot significantly closer to the cleat assembly, the present invention makes walking in a cleated cycling shoe easier. Additionally, by combining a four-hole mounting standard with the curved shoe sole 12, the cleat assembly is able to follow the general contour of the user's foot as the cleat assembly is moved forward or rearward with respect to the shoe sole. This feature assists in maintaining an optimal foot-to-pedal distance as the cleat assembly is moved forward or rearward. Furthermore, unlike the prior art mounting standards, the internal nut assemblies 16 can accommodate a slight amount of rotational adjustment of the cleat assembly with respect to the shoe sole.

Figure 6:
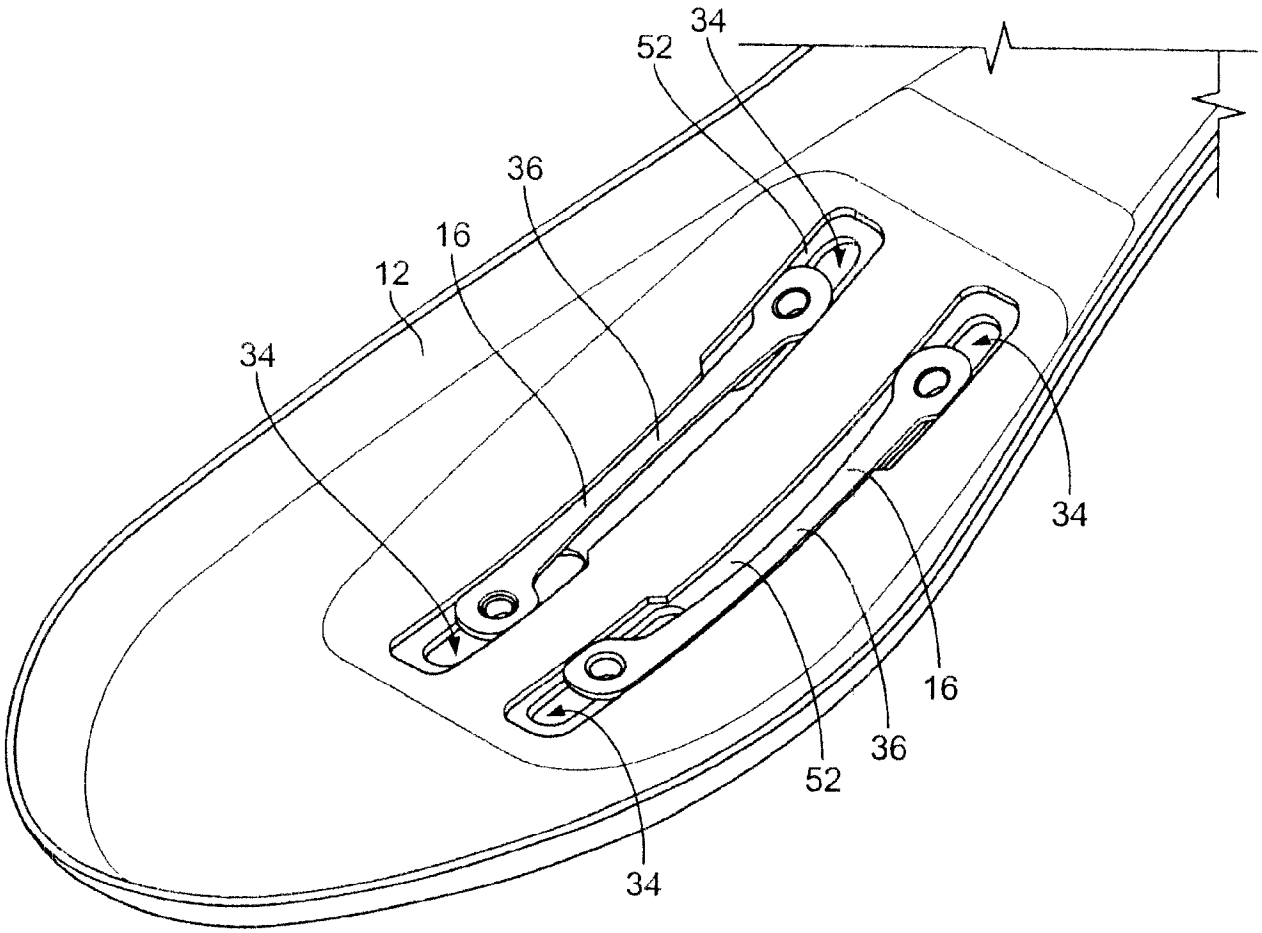
FIG. 6 is a perspective view of the top side of the shoe sole and pair of internal nut assemblies in accordance with an embodiment of the present invention.

With reference to FIG. 6, there is shown a perspective view of the top side of the curved shoe sole 12 and a pair of internal nut assemblies 16, the nuts 32 of the internal nut assemblies extending through the mounting holes 34 in the shoe sole. As shown in FIG. 6, each internal nut assembly acts like a spanner wrench inside the shoe, once one of the nuts 32 is in place within one of the mounting holes. In other words, when a user tightens or loosens a screw 44 into or out of a nut 32, the internal nut assembly acts as a rotation stabilizer due to its long "dogbone" shape, inhibiting the nut from spinning inside the shoe sole.

Also shown in FIG. 6 are a pair of channels 52 formed in the top side of the shoe sole 12 and extending lengthwise along the shoe sole. Each channel encompasses two of the mounting holes 34 in the shoe sole and is configured to receive one of the internal nut assemblies 16. Embedding the internal nut assemblies in the channels reduces the distance from the user's foot to the bottom of the shoe sole. The channels also inhibit the internal nut assemblies from spinning inside the shoe when a user tightens or loosens a screw 44 into or out of a nut 32.

Although the invention has been described in detail with reference only to the presently preferred embodiments, those skilled in the art will appreciate that various modifications can be made without departing from the invention. Accordingly, the invention is defined only by the following claims.

What is claimed is:

1. A cleat assembly mounting system comprising: a shoe sole having a curved underside portion, and a plurality of mounting holes; a cleat assembly for engaging a bicycle pedal; a shim configured to be secured to the curved underside portion of the shoe sole for mounting the cleat assembly to the shoe sole, the shim having a plurality of shim holes configured for alignment with the plurality of mounting holes; and one or more nut assemblies, each of the one or more nut assemblies having a nut, for securing the shim to the curved underside portion of the shoe sole using a set of threaded fasteners through the plurality of mounting holes and the plurality of shim holes; wherein each of the plurality of mounting holes is configured as a slot extending in a first direction, on the curved underside portion of the shoe sole, each of the plurality of mounting holes having a length and a width, the length being greater than the width, the first direction being defined by the mounting hole length; wherein each of the plurality of shim holes is configured as a slot extending in a second direction on a portion of the shim, each of the plurality of shim holes having a length and a width, the length being greater than the width, the first direction being defined by the shim hole length; wherein the second direction is substantially orthogonal to the first direction; and wherein the cleat assembly comprises a spring housing, and a metal bottom plate configured to be secured to the shim and further configured to conformably receive the bicycle pedal.

2. The cleat assembly mounting system of claim 1, wherein the shim is a contoured shim further having:

a curved top surface shaped generally to follow the curved underside portion of the shoe sole; and a flat bottom surface.

3. The cleat assembly mounting system of claim 1, wherein the one or more nut assemblies comprises a plurality of nut assemblies.

4. The cleat assembly mounting system of claim 3, wherein:

each of the plurality of nut assemblies has two nuts; and each of the plurality of nut assemblies further has a bar connecting the two nuts.

5. The cleat assembly mounting system of claim 1, wherein the cleat assembly is configured to be secured, by the set of threaded fasteners, to the shim.

6. A cleat assembly mounting system comprising; a shoe sole having a curved underside portion, and a plurality of mounting holes; a cleat assembly for engaging a bicycle pedal; a shim configured to be secured to the curved underside portion of the shoe sole for mounting the cleat assembly to the shoe sole, the shim having a plurality of shim holes configured for alignment with the plurality of mounting holes, the plurality of mounting holes and plurality of shim holes having a length and a width, with the length being greater than the width; and one or more nut assemblies for securing the shim to the curved underside portion of the shoe sole using a set of threaded fasteners through the plurality of mounting holes and the plurality of shim holes; wherein each of the one or more nut assemblies comprises two nuts having a fixed spacing relative to one another; and wherein the cleat assembly comprises a spring housing, and a metal bottom plate configured to be secured to the shim and further configured to conformably receive the bicycle pedal.

7. The cleat assembly mounting system of claim 6, wherein the shim is a contoured shim further having:

a curved top surface shaped generally to follow the curved underside portion of the shoe sole; and a flat bottom surface.

8. The cleat assembly mounting system of claim 6, wherein the one or more nut assemblies comprises a plurality of nut assemblies.

9. The cleat assembly mounting system of claim 6, wherein each of the one or more nut assemblies further comprises a bar connecting the two nuts.

10. The cleat assembly mounting system of claim 6, wherein:

each of the plurality of mounting holes is configured as a slot extending in a first direction on the curved underside portion of the shoe sole;

each of the plurality of shim holes is configured as a slot extending in a second direction on a portion of the shim; and the second direction is substantially orthogonal to the first direction.

11. The cleat assembly mounting system of claim 6, wherein the cleat assembly is configured to be secured, by the set of threaded fasteners, to the shim.

12. A mounting standard for mounting a cleat assembly to a shoe sole having a curved underside portion and a plurality of mounting holes, the cleat assembly comprising a spring housing and a metal bottom plate, configured to conformably receive the bicycle pedal, the mounting standard comprising: a shim, separate from the cleat assembly and having a plurality of shim holes; and one or more nut assemblies for securing the shim to the curved underside portion of the shoe sole using a set of threaded fasteners through the plurality of mounting holes and the plurality of shim holes: wherein the plurality of mounting holes and the plurality of shim holes each have a length and a width, wherein the length is longer than the width, the plurality of shim holes being orthogonal to the plurality of mounting holes and wherein each of the one or more nut assemblies comprises two nuts having a fixed spacing relative to one another.

13. The mounting standard of claim 12, wherein the shim is a contoured shim further having:

a curved top surface; and a flat bottom surface.

14. The mounting standard of claim 12, wherein the one or more nut assemblies comprises a plurality of nut assemblies.

15. The mounting standard of claim 12, wherein each of the one or more nut assemblies further comprises a bar connecting the two nuts.

16. The mounting standard of claim 12, wherein each of the plurality of shim holes is configured as a slot extending in a widthwise direction on a portion of the shim.

17. The mounting standard of claim 12, wherein the cleat assembly is configured to be secured, by the set of threaded fasteners, to the shim.

* * * * *